US009943102B1

(12) United States Patent
Bohl, Sr.

(10) Patent No.: US 9,943,102 B1
(45) Date of Patent: Apr. 17, 2018

(54) ROLLING APPARATUS TO ASSEMBLE A CIGARETTE WITH ENHANCED EFFICIENCY

(71) Applicant: Trent Alan Bohl, Sr., Silver City, NM (US)

(72) Inventor: Trent Alan Bohl, Sr., Silver City, NM (US)

( * ) Notice: Subject to any disclaimer, the term of this patent is extended or adjusted under 35 U.S.C. 154(b) by 265 days.

(21) Appl. No.: 14/823,724

(22) Filed: Aug. 11, 2015

Related U.S. Application Data

(60) Provisional application No. 62/036,191, filed on Aug. 12, 2014.

(51) Int. Cl.
*A24C 5/10* (2006.01)
*A24C 5/46* (2006.01)
*A24C 5/40* (2006.01)

(52) U.S. Cl.
CPC ..... *A24C 5/465* (2013.01); *A24C 5/40* (2013.01)

(58) Field of Classification Search
None
See application file for complete search history.

(56) References Cited

U.S. PATENT DOCUMENTS 5,657,773 A 8/1997 George
5,816,264 A * 10/1998 Sebastiani ..... A24F 15/20 131/290
2005/0218539 A1* 10/2005 Lebe ..... G11B 23/505 264/1.33

* cited by examiner

*Primary Examiner* — Michael H Wilson
*Assistant Examiner* — Phu Nguyen
(74) *Attorney, Agent, or Firm* — Plager Schack LLP; Mark H. Plager

(57) ABSTRACT

A rolling apparatus for use in rolling a cigarette that includes a rolled outer tubular member able to store a smoking material and a rolled filter member disposed within proximate an end of the tubular member. The rolling apparatus includes a cylindrical member, and a pair of elongated members coupled to a first end of the cylindrical member, the elongated members positioned substantially parallel to each other and separated by a distance to create a slot between the elongated members. The elongated members receive a filter sheet that is disposed through the slot and around the elongated members to permit a user to wrap the filter sheet around the elongated members to create the rolled filter member. The apparatus receives an outer sheet to permit the user to wrap the outer sheet around the cylindrical member and the rolled filter member to create the rolled outer tubular member.

5 Claims, 4 Drawing Sheets

FIG.8
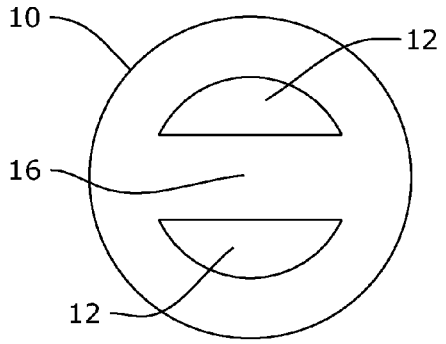
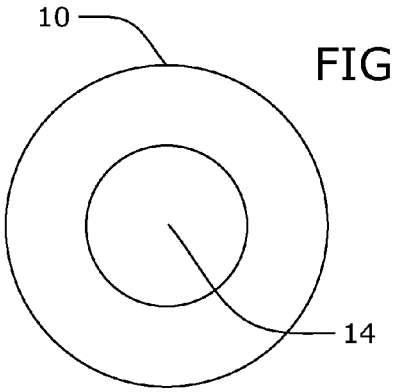
FIG.9
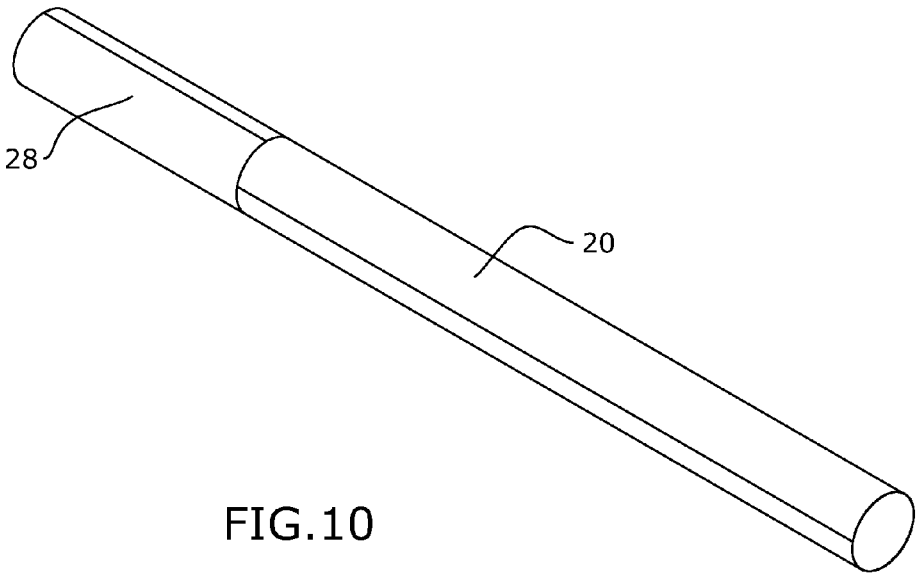
FIG.10

ROLLING APPARATUS TO ASSEMBLE A CIGARETTE WITH ENHANCED EFFICIENCY

RELATED APPLICATION

The application claims priority to provisional patent application U.S. Ser. No. 62/036,191 filed on Aug. 12, 2014, the entire contents of which is herein incorporated by reference.

BACKGROUND

The embodiments herein relate generally to cigarettes for use with herbal products or tobacco.

Individuals often roll their own cigarettes to smoke tobacco or herbs. Rolling paper is rolled into a tubular member to store the smoking material. A filter may be rolled and/or folded and placed within an end of the tubular member. The tubular member is filled with the smoking material to finish the cigarette. The advantages of rolling cigarettes at home instead of purchasing pre-made products allow users to customize the cigarette to better suit their needs and reduce overall costs.

As disclosed in U.S. Pat. No. 5,657,773, the process of rolling cigarettes by hand is difficult and requires patience, steady hands and dexterity. Individuals who are handicapped or suffer from ailments such as arthritis may not be able to perform these tasks. In addition, the process of rolling paper and/or filters manually by hand is time consuming and likely to result in cigarettes that are untidy and/or asymmetric, which detracts from the smoking experience and/or renders the cigarettes unusable.

As such, there is a need in the industry for a rolling apparatus that addresses the limitations of the prior art, which permits a user to assemble a higher quality rolled cigarette with enhanced efficiency.

SUMMARY

A rolling apparatus for use in rolling a cigarette with enhanced efficiency is provided. The cigarette comprises a rolled outer tubular member configured to store a smoking material therein and a rolled filter member disposed within the tubular member and positioned proximate an end of the tubular member. The rolling apparatus comprises a cylindrical member comprising a first end and a second end, and a pair of elongated members mechanically coupled to the first end of the cylindrical member, the pair of elongated members positioned substantially parallel to each other and separated by a distance to create a slot between the elongated members, wherein the pair of elongated members are configured to receive a filter sheet that is disposed through the slot and around the elongated members to permit a user to wrap the filter sheet around the elongated members to create the rolled filter member, wherein the apparatus is configured to receive an outer sheet to permit the user to wrap the outer sheet around the cylindrical member and the rolled filter member to create the rolled outer tubular member. In certain embodiments of the invention, each elongated member in the pair of elongated members comprises a generally semi-circular cross-section.

BRIEF DESCRIPTION OF THE FIGURES

The detailed description of some embodiments of the invention will be made below with reference to the accompanying figures, wherein the figures disclose one or more embodiments of the present invention.

FIG. 8 depicts a left side view of certain embodiments of the rolling apparatus;

FIG. 9 depicts a right side view of certain embodiments of the rolling apparatus; and FIG. 10 depicts a perspective view of certain embodiments of the rolling apparatus illustrating an alternative embodiment of a rolled cigarette.

DETAILED DESCRIPTION OF CERTAIN EMBODIMENTS

As depicted in FIGS. 1-4, rolling apparatus 10 is configured to assemble a cigarette with crutch 18 and rolling paper 20. Crutch 18 is a filter sheet that is wrapped around rolling apparatus 10 to form a filter member for the cigarette. The filter sheet may be made from various materials known in the field including, but not limited to, hemp paper, other types of paper fiber, cardstock, or the like. Rolling paper 20 is a generally rectangular sheet made from any material or combination of materials known in the field such as hemp paper, other types of paper, cellophane, or the like. Rolling paper 20 comprises gum edge 22, which is an adhesive used to secure the edge of the paper to itself. Rolling paper 20 is wrapped around rolling apparatus 10 and crutch 18 to form the outer tubular structure of a cigarette. It shall be appreciated that the interior of the outer tubular structure may be filled with any smoking material such as herbs or tobacco.

Figure 1:
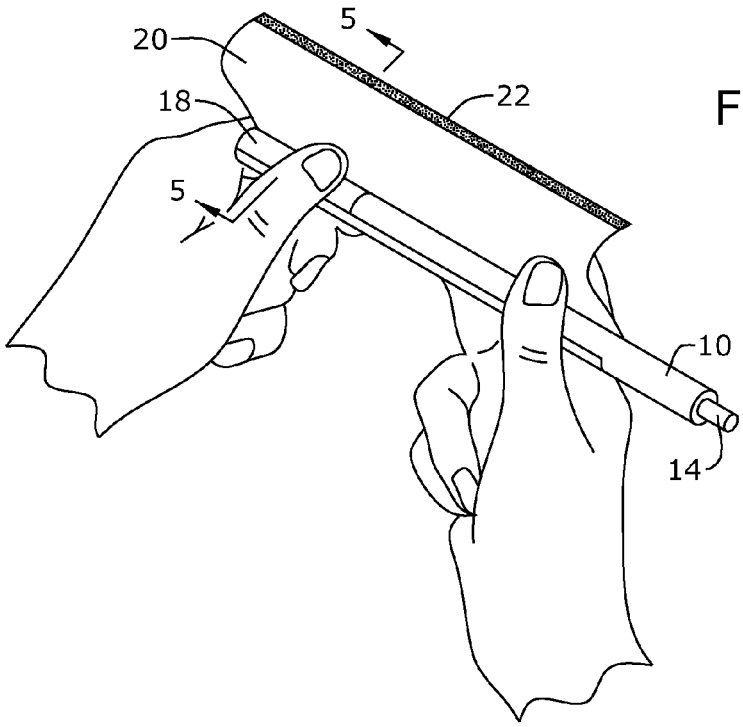
FIG. 1 depicts a perspective view of certain embodiments of the rolling apparatus shown in use.
Figure 2:
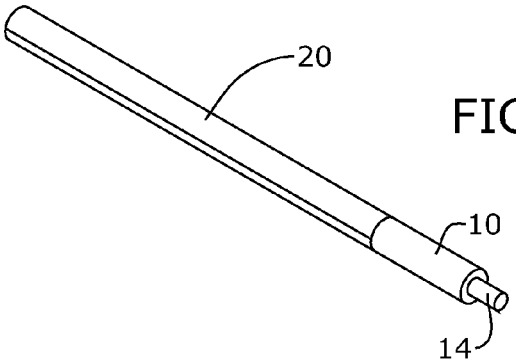
FIG. 2 depicts a perspective view of certain embodiments of the rolling apparatus illustrating a rolled cigarette.
Figure 3:
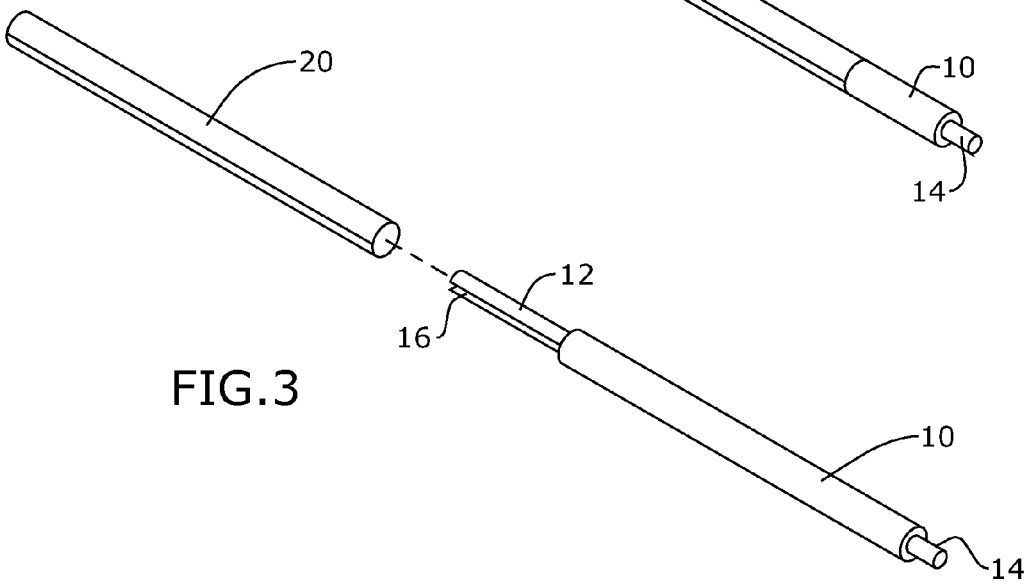
FIG. 3 depicts a perspective view of certain embodiments of the rolling apparatus illustrating the removal of the apparatus from the rolled cigarette.
Figure 4:
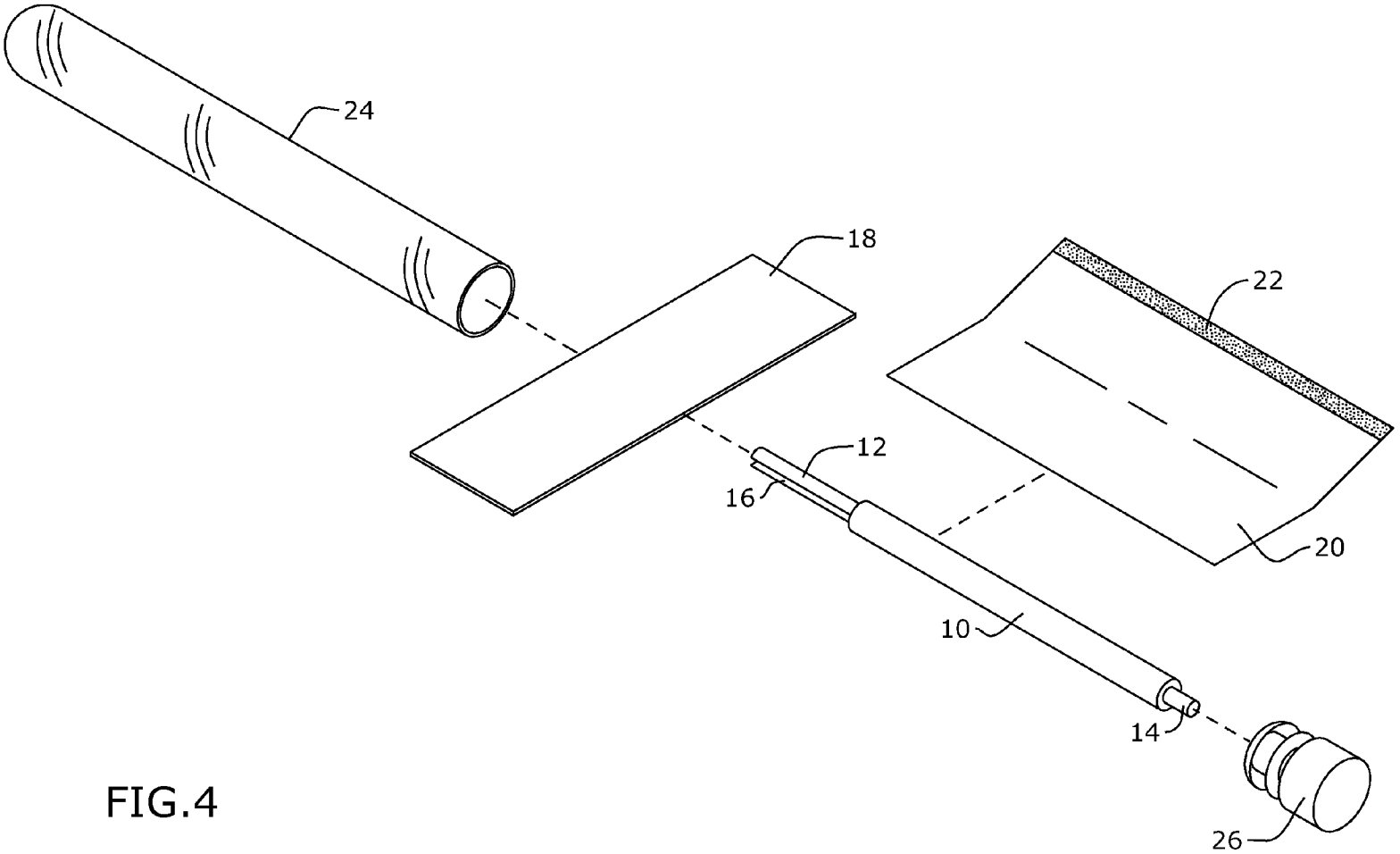
FIG. 4 depicts an exploded view of certain embodiments of the rolling apparatus.
Figure 6:
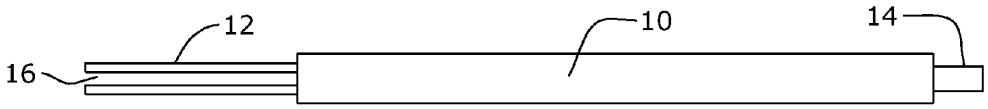
FIG. 6 depicts a front view of certain embodiments of the rolling apparatus.
Figure 7:
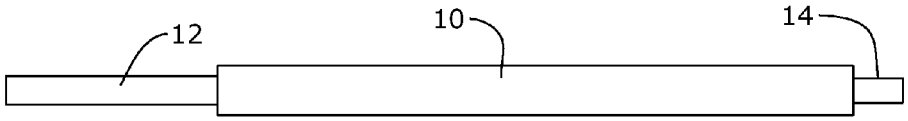
FIG. 7 depicts a top view of certain embodiments of the rolling apparatus.

As depicted in FIGS. 4 and 6-7, rolling apparatus 10 comprises a base cylindrical member, a pair of elongated members 12 and tapping end 14. Elongated members 12 are coupled to a first end of the base cylindrical member and oriented substantially parallel to each other. In a preferred embodiment, elongated members 12 are separated by a distance to create slot 16 as depicted in FIG. 8. The distance between elongated members 12 is preferably 2.1 millimeters. However, this distance may vary. Tapping end 14 is a cylindrical member coupled to the second end of the base cylindrical member as depicted in FIG. 9. In one embodiment, the length of rolling apparatus 10 is approximately 144 millimeters. However, the dimensions of rolling apparatus 10 may vary.

In certain embodiments, rolling apparatus 10 comprises a storage apparatus comprising non-rattle tube 24 and non-rattle end cap 26. Non-rattle tube 24 comprises an opening sufficiently large to receive rolling apparatus 10. Non-rattle end cap 26 can be secured to non-rattle tube 24 to completely enclose rolling apparatus 10. Non-rattle end cap 26 can be attached or detached from non-rattle tube 24 as many times as desired. It shall be appreciated that rolling apparatus 10 may be made from any materials known in the field including, but not limited to, aluminum, other metals, plastic, wood, or the like.

Figure 5:
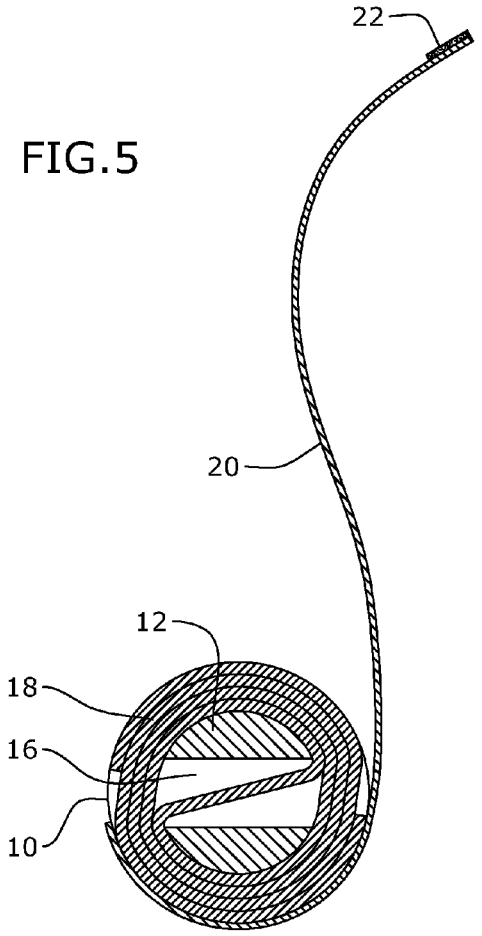
FIG. 5 depicts a section view of certain embodiments of the rolling apparatus taken along line 5-5 in FIG. 1.

In operation, rolling apparatus 10 is used to assemble a rolled cigarette. Crutch 18 is positioned such that the filter sheet is disposed within slot 16 between elongated members 12 of rolling apparatus 10 as shown in FIG. 5. A user rotates rolling apparatus 10 to wrap the filter sheet around elongated members 12 to complete the assembled crutch 18. Depending on how the filter sheet is oriented within slot 16 and wrapped around elongated members 12, different shaped crutches 18 may be formed including, but not limited to, S-shape, M-shape, P-shape, I-shape, twisted flower and alternative shaped crutches. Rolling paper 20 is disposed around rolling apparatus 10. The user rotates rolling apparatus 10 to wrap rolling paper 20 around the base cylindrical member and crutch 18 to form the cigarette's structure. After rolling paper 20 is completely wrapped to form an outer tubular member, gum edge 22 is moistened to activate the adhesive to permit the edge of rolling paper 20 to be secured to itself. Rolling apparatus 10 is removed from rolling paper 20 and crutch 18.

To complete the cigarette, any type of smoking material (not shown) such as herbs or tobacco is disposed within the rolled rolling paper. It shall be appreciated that rolling apparatus 10 assembles rolled cigarettes that can be used with any cigarette filling devices (not shown) known in the field. Once the smoking material is disposed within rolled rolling paper 20, a user can insert tapping end 14 of rolling apparatus 10 into the end of rolled rolling paper 22 opposite the end where crutch 18 is located. This permits tapping end 14 to push the smoking material further into the rolled rolling paper 20 to permit a user to close/seal the end of the cigarette.

In an alternative embodiment, a user may secure crutch cover 28 around the exterior of rolling paper 20 above crutch 18 as shown in FIG. 10. Crutch cover 28 is a sheet made from any material known in the field to enhance the aesthetics of the assembled cigarette. Crutch cover 28 may comprise any words, designs or logos to serve for promotional purposes. It shall be appreciated that a user may use rolling apparatus 10 as a tool to help wrap crutch cover 28 around rolling paper 20.

It shall be appreciated that the components of rolling apparatus 10 described in several embodiments herein may comprise any alternative known materials in the field and be of any color, size and/or dimensions. It shall be appreciated that the components of rolling apparatus 10 described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A rolling apparatus for use in rolling a cigarette with enhanced efficiency, the cigarette comprising a rolled outer tubular member configured to store a smoking material therein and a rolled filter member disposed within the tubular member and positioned proximate an end of the tubular member, the rolling apparatus comprising:

a cylindrical member comprising a first end, a second end opposite the first end, and a cross-section oriented generally perpendicular to a longitudinal axis of the cylindrical member, the cross-section extending from the first end to the second end with a generally constant diameter; and a pair of elongated members mechanically coupled to a central portion of the first end of the cylindrical member to create unobstructed space on a surface along a perimeter of the first end of the cylindrical member, the pair of elongated members positioned substantially parallel to each other and separated by a distance of approximately 2.1 millimeters to create a slot between the elongated members;

wherein the pair of elongated members are configured to receive a filter sheet that is disposed through the slot and around the elongated members to permit a user to wrap the filter sheet around the elongated members to create the rolled filter member, wherein the apparatus is configured to receive an outer sheet to permit the user to wrap the outer sheet around the cylindrical member and the rolled filter member to create the rolled outer tubular member.

2. The rolling apparatus of claim 1, wherein each elongated member in the pair of elongated members comprises a generally semi-circular cross-section with a curved outer surface connected to a flat outer surface, wherein the flat outer surfaces of the elongated members face toward each other and the curved outer surfaces of the elongated members face away from each other.

3. The rolling apparatus of claim 2, further comprising a cylindrical end member mechanically coupled to the second end of the cylindrical member, wherein a first cross-sectional diameter of the cylindrical member is greater than a second cross-sectional diameter of the cylindrical end member.

4. The rolling apparatus of claim 3, further comprising a tubular housing member comprising a closed end and an open end opposite the closed end, wherein the tubular housing member is configured to receive the cylindrical member, elongated members and cylindrical end member through the open end.

5. The rolling apparatus of claim 4, further comprising a cap detachably coupled to the open end of the tubular housing member.

* * * * *